United States Patent [19]

Snyder et al.

[11] 4,394,966

[45] Jul. 26, 1983

[54] SPRAYING APPARATUS HAVING A FLUID STORAGE TANK WITH AGITATOR AND ANTI-VORTEX TANK FITTINGS

[75] Inventors: Larry L. Snyder; Martin T. Smith, Jr., both of Lincoln, Nebr.

[73] Assignee: Snyder Industries, Inc., Lincoln, Nebr.

[21] Appl. No.: 904,274

[22] Filed: May 9, 1978

[51] Int. Cl.[3] ..... B05B 9/00

[52] U.S. Cl. ..... 239/127; 239/142; 366/154

[58] Field of Search ..... 239/142, 148, 127; 137/590, 592; 210/208, 219, 319; 4/172.17, 196; 222/564; 366/154, 165, 167

[56] References Cited

U.S. PATENT DOCUMENTS

| | | | |
|---|---|---|---|
| 2,224,741 | 12/1940 | Metrick et al. | 239/373 X |
| 2,692,798 | 10/1954 | Hicks | 239/142 X |
| 2,732,071 | 1/1956 | Crow | 137/592 X |
| 2,946,345 | 7/1960 | Weltmer | 137/590 |
| 3,247,969 | 4/1966 | Miller | 239/142 X |
| 3,276,698 | 10/1966 | Wood | 239/571 X |
| 3,361,357 | 1/1968 | Johnston | 239/142 X |
| 3,636,976 | 1/1972 | Hansel | 137/590 |
| 3,782,416 | 1/1974 | Levin | 137/590 |
| 4,044,079 | 8/1977 | Tveit | 366/165 X |

FOREIGN PATENT DOCUMENTS 1508344 11/1967 France .

*Primary Examiner*—John J. Love

*Attorney, Agent, or Firm*—Schuyler, Banner, Birch, McKie & Beckett

[57] ABSTRACT

A spraying apparatus, which sprays herbicides, fungicides and insecticides mixed in water or liquid fertilizer, includes a fluid storage tank, a pump and one or more spray heads. An agitator, which is mounted in the fluid storage tank on the end of a bypass return pipe extending between the pump and the fluid storage tank, mixes the fluid in the fluid storage tank. The agitator includes a conical plate or cap overlaying the opening in the bypass return pipe. Spiral shaped fins or ribs are mounted on the concave side of the conical plate for directing the fluid from the bypass return pipe in a spiral rotating fashion to thereby mix the fluid in the fluid storage tank by imparting a gentle rolling action to the fluid. A nozzle between the bypass return pipe and the conical plate provides a fixed gap to control the fluid momentum in the fluid storage tank. The spraying apparatus also includes an anti-vortex device mounted on a fluid outlet pipe. This anti-vortex device, which prevents the formation of a gyrating vortex by forcing the fluid in the fluid storage tank to make a 90 degree turn as it is discharged, includes a cap which overlays the opening in the fluid outlet pipe at a fixed distance. The anti-vortex device prevents pump cavitation so that the pump operates more efficiently.

25 Claims, 5 Drawing Figures

SPRAYING APPARATUS HAVING A FLUID STORAGE TANK WITH AGITATOR AND ANTI-VORTEX TANK FITTINGS

BACKGROUND OF THE INVENTION

The present invention is directed to spraying apparatus which includes a fluid storage tank having an agitator for mixing the fluid in the fluid storage tank and an anti-vortex device for preventing the formation of a gyrating vortex in the fluid as the fluid is discharged from the fluid storage tank.

Emulsifiable or wettable powders are frequently employed as active ingredients for a variety of applications, including agricultural herbicides, insecticides or fungicides, as well as other industrial uses. When these emulsifiable or wettable powders are mixed in water solutions or mixed with liquid fertilizer, the solid particles tend to settle and collect at the bottom of the fluid storage tank since these particles are normally only held in suspension rather than being dissolved in the solution. In order to improve the performance of spraying apparatus for spraying fluids containing these emulsifiable or wettable powders, it is necessary to agitate the fluid in the fluid storage tank in order to maintain these emulsifiable or wettable powders in substantially homogeneous suspension at all times.

As is generally known in the art, spraying apparatus of this type generally includes a fluid storage tank which is connected to a pump for pumping the fluid stored in the fluid storage tank to spray heads or nozzles. Normally, agitation of the fluid in the fluid storage tank is accomplished by returning a portion of the solution from the pump back to the fluid storage tank viz a bypass pipe. The momentum of the fluid in the bypass pipe agitates the fluid in the fluid storage tank. An example of such a spraying apparatus is shown in U.S. Pat. No. 2,692,798 issued to Hicks on Oct. 26, 1954. In this patent, the bypass pipe protrudes into the fluid storage tank and a biased agitator cap is responsive to the pressure of the fluid in the bypass pipe to permit the bypass fluid to flow into the fluid storage tank to thereby mix the fluid contained therein.

Different arrangements have been used in the prior art to improve the agitation in such spraying apparatus. For example, Venturi mixer nozzles have been connected on the end of the bypass pipe near the bottom of the fluid storage tank to draw the settling or precipitating particles and the surrounding liquid into the Venturi mixer nozzle whereupon it is discharged with force sufficient to agitate the fluid in the fluid storage tank. Agitator devices which employ Venturi mixer nozzles are shown in U.S. Pat. No. 3,826,474 issued to Pareja on July 30, 1974 and French Pat. No. 1,142,557 published on Sept. 19, 1957. Other types of nozzles have been employed in the prior art for improving the agitation of the fluid in the fluid storage tank. In U.S. Pat. No. 3,661,364 issued to Lage on May 9, 1972, a pressure nozzle is located near the bottom of the fluid storage tank in order to subject the fluid in the fluid storage tank to a rotationally symmetrical circulatory movement as the fluid in the bypass pipe impinges against the bottom of the tank. As a result of the impact of the fluid from the bypass pipe on the tank bottom, a particular mixing effect is achieved.

Another technique employed in the prior art for mixing the fluid in a fluid storage tank is a sparging system in which agitation of the fluid is achieved by introducing compressed air into the fluid. For example, in U.S. Pat. No. 2,224,741 issued to Metrick et al on Dec. 10, 1940, compressed air is forced from an inlet pipe through spiral channels near the bottom of the fluid storage tank to thereby mix the fluid in a spiral rotating fashion. Similarly, U.S. Pat. No. 3,276,698 issued to Wood on Oct. 4, 1966 shows a system in which compressed air is introduced into the fluid through a protruding pipe having a movable closure cap responsive to the pressure of the compressed air. The closure cap overlays the opening of the protruding pipe when no air is fed to the agitator. Under air pressure, the closure cap rises to create an annular opening through which the compressed air passes into the fluid in the fluid storage tank. The underside of the closure cap includes a plurality of spiral ribs which impart a spiral rotating motion to the compressed air as it passes through the annular opening.

While the above systems have been generally acceptable and widely used in the past, these systems fail to provide adequate control of the mixing process and they often result in localized agitation. These systems either fail to mix enough of the fluid or they overmix. By undermixing, the solid particles that are not in solution tend to fall out as sediment and are no longer fed to the spray heads or nozzles through the pump. On the other hand, overmixing can cause certain combinations of herbicides, fungicides, insecticides, and fertilizers to form a gel-like consistency. Therefore, there is need for a device which overcomes these disadvantages by providing more precise control of the mixing of the fluid in the fluid storage tank.

In addition to the disadvantages of prior art agitators, the pump in prior art spraying apparatus has a tendency to cavitate or suck in air as the fluid is withdrawn from the fluid storage tank. In particular, when the fluid outlet pipe is connected to the bottom of the fluid storage tank, it is quite common for a gyrating vortex to be generated in the fluid as it enters the fluid outlet pipe. Cavitation of the pump is caused by creating excessive low pressure at the suction side of the pump which either vaporizes the fluid or causes such a quantity of the fluid to move into the pump that a gyrating vortex is generated within the fluid. This gyrating vortex or hollow core permits air to enter the pump and causes the pump to lose prime and invariably causes a loss of pump efficiency. As a result, rapid wear on the pump impeller occurs.

SUMMARY OF THE INVENTION

It is an object of the present invention to overcome the above disadvantages of the prior art spraying apparatus by providing a spraying apparatus having an agitator for properly mixing the fluid in the fluid storage tank and an anti-vortex device for preventing pump cavitation in the fluid in the fluid storage tank.

In particular, it is an object of the present invention to provide an agitator for a spraying apparatus in which agitation is accomplished over a wide range of pressures and flow rates by imparting a gentle rolling motion to the fluid in the fluid storage tank. It is an object of the present invention to provide an agitator in which mixing down to as low as two pounds per square inch and five gallons per minute and up to ten pounds per square inch and fifty gallons a minute can be achieved. These values fall within the normal range of bypass pump systems presently used in the agricultural industry.

It is a further object of the present invention to provide an agitator for a spraying apparatus which does not use compressed air or a Venturi nozzle and therefore the possibility of introducing air in the fluid in the fluid storage tank is minimized. In this regard, it is an object of the present invention to provide a liquid-to-liquid agitating system in which the momentum of the fluid in the bypass pipe of the spraying apparatus is transferred to the fluid in the fluid storage tank to thereby mix the fluid in the fluid storage tank by imparting a gentle rolling motion to the fluid.

In addition, it is an object of the present invention to provide an agitator in which the momentum direction is changed by 90 degrees by a conical plane mounted over the opening in the bypass return pipe to provide a focus for the bypass fluid. It is likewise an object to provide spiral shaped fins on the conical plate for directing the fluid from the bypass pipe in a spiral rotating motion which is transferred to the fluid in the fluid storage tank. In this manner, it is an object of the present invention to distribute the fluid in the bypass prior over a wide area in the fluid storage tank in order to impart a gentle rolling motion of the fluid in the fluid storage tank rather than creating any localized spots of agitation.

It is also an object of the present invention to prevent the pump of the spraying apparatus from cavitating by preventing the formation of any gyrating vortex in the fluid as the fluid leaves the fluid discharge tank. In this regard, it is an object of the present invention to force the fluid leaving the fluid discharge tank to make a substantially 90 degree turn in order to leave the fluid storage tank. In this manner, it is an object of the present invention to provide an anti-vortex device which makes any gyrating vortex become self-destructive.

Other and further objects of the present invention will become apparent to those skilled in the art upon examination of the following specification, claims and accompanying drawings.

The invention is directed to spraying apparatus for spraying a fluid stored in a fluid storage tank. The spraying apparatus includes a pump connected to the fluid storage tank by a fluid outlet pipe and spray heads connected to the pump by a spray pipe. The spray heads spray the fluid pumped from the fluid storage tank. A bypass return pipe is also connected between the spray pipe and the fluid storage tank for returning a portion of the fluid to the fluid storage tank. In particular, the present invention is directed to an agitator connected to the bypass return pipe for mixing the fluid in the fluid storage tank and an anti-vortex device connected to the fluid outlet pipe for preventing the formation of a gyrating vortex in the fluid in the fluid storage tank.

The agitator mixes the fluid in the fluid storage tank by transferring the momentum of the fluid in the bypass return pipe to the fluid in the fluid storage tank. The agitator includes a conical plate having its concave side overlaying the opening in the bypass return pipe at a fixed distance therefrom. Spiral shaped ribs or fins are mounted on the concave side of the conical plate for imparting a spiral rotating motion of the fluid discharged by the bypass return pipe. The shape of the conical plate provides a focusing or directing effect on the fluid discharged by the bypass return pipe which in turn allows the spiral shaped ribs or fins to be considerably more effective in distributing the fluid. The agitator further includes a nozzle coupled between the opening in the bypass return pipe and the conical plate. This nozzle extends substantially along the center line of the conical plate for defining a fixed gap between the conical plate and the nozzle. The fixed gap formed by the nozzle controls the pressure drop across the conical plate and the nozzle to thereby control the momentum of the fluid in the fluid storage tank. In addition, the nozzle directs the fluid from the bypass return pipe to the center of the conical plate to help provide an even distribution of the fluid from the bypass return pipe. As a result of the combination of these elements, the fluid from the bypass return pipe is discharged in the fluid storage tank in a spiral rotating fashion to thereby mix the fluid in the fluid storage tank by imparting a gentle rolling motion thereto.

Various modifications may be made in the agitator of the present invention to control the mixing of the fluid in the fluid storage tank. For example, the fixed gap defined by the nozzle may be smaller than the height of the spiral shaped fins near the center of the conical plate in order to improve the spiral shaped motion of the fluid in the fluid storage tank. Also, the nozzle may be modified to change the length of the fixed gap in order to vary the pressure drop across the gap. Although the agitator performs most efficiently when mounted in a vertical position on the bottom wall of the fluid storage tank, it is recognized that the agitator may also be mounted on a bypass return pipe which protrudes into the fluid storage tank or a bypass return pipe which enters through one of the other walls of the fluid storage tank.

The anti-vortex device of the present invention is mounted on the bottom wall of the fluid storage tank and is connected to the fluid outlet pipe.The anti-vortex device prevents the formation of a gyrating vortex in the fluid as it leaves the fluid storage tank. To this end, a cap overlays the opening in the fluid outlet pipe at a fixed distance therefrom for forcing the fluid in the fluid storage tank to make a substantially 90 degree turn in order to leave through the fluid outlet pipe. Generally, the cap extends beyond, and is positioned slightly above, the opening in the fluid outlet pipe.

One of the essential features of the present invention is that the agitator and the anti-vortex device are made of similar elements which are removable. For example, the conical plate and the nozzle of the agitator may be removed from the tank fitting which attaches the agitator to the bypass return pipe. This not only facilitates repair of the agitator, but since the cap of the anti-vortex device may be the same as the conical plate in the agitator, the agitator can be converted into an anti-vortex device simply by removing the nozzle. Thus, the primary structural difference between the agitator and the anti-vortex device is the use of a nozzle in the agitator to control the fluid momentum in the fluid storage tank. The similarity of these elements greatly simplifies the manufacturing process which in turn lowers the overall cost.

DESCRIPTION OF THE PREFERRED EMBODIMENT

Figure 2:
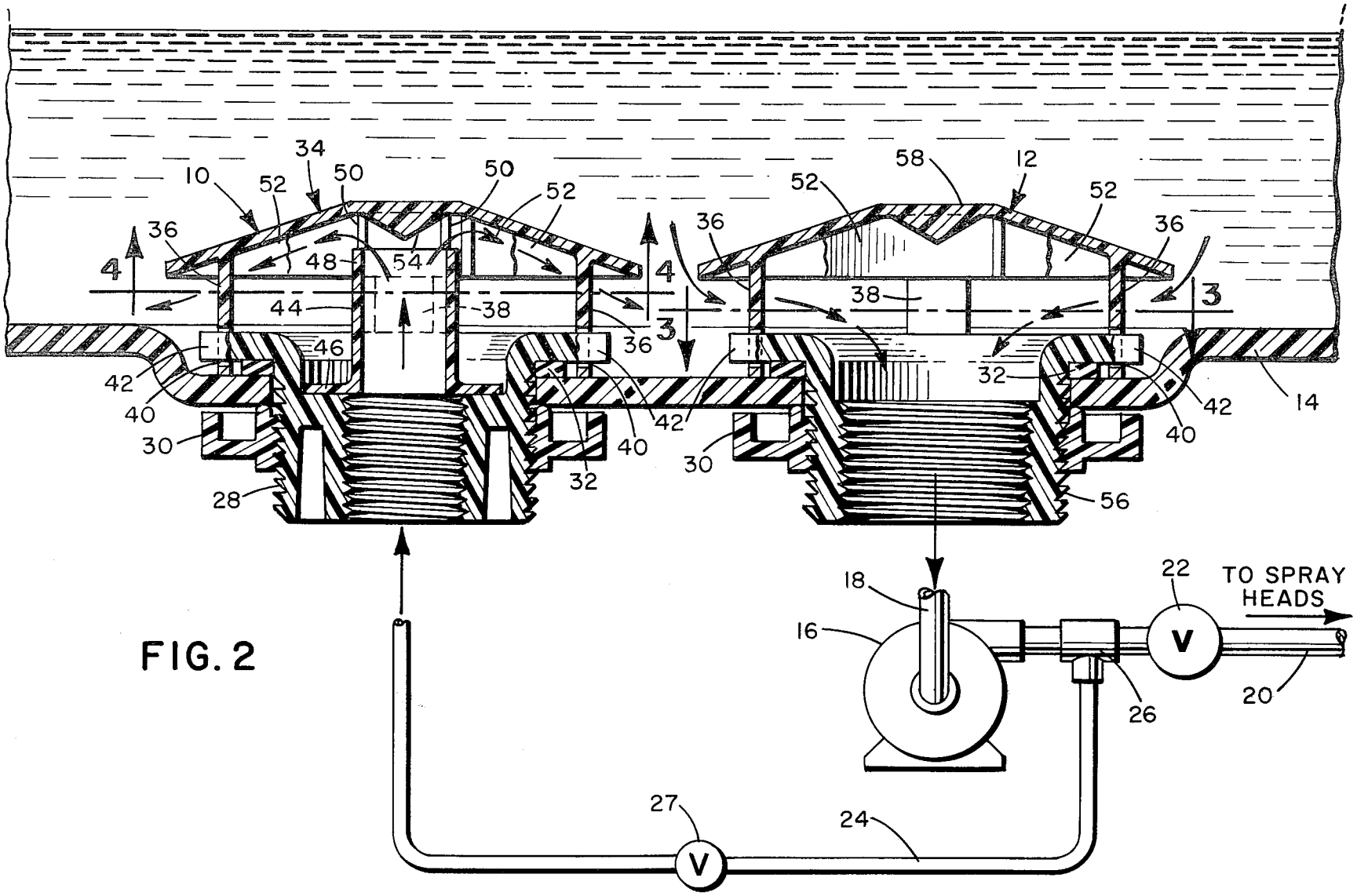
FIG. 2 shows the spraying apparatus of the present invention including a cross sectional view of the agitator and the anti-vortex device taken along lines 2—2 of FIG. 1.

Referring now to the drawings, the spraying apparatus of the present invention is shown in FIG. 2 which includes a cross sectional view of the agitator 10 and the anti-vortex device 12 mounted on fluid storage tank 14. The anti-vortex device 12 is connected to a pump 16 by a fluid outlet pipe 18. The pump 16 forces the fluid from the fluid storage tank 14 to one or more spray heads or nozzles which are connected to the pump 16 by spray pipe 20 and valve 22. Although the spray heads are not shown in the drawings, any one of a number of known spray heads may be used in the present invention. A bypass return pipe 24 is also connected to the outlet of the pump 16 via a tee 26 which is connected to the spray pipe 20. A portion of the fluid pumped by the pump 16 is returned to the fluid storage tank 14 for the purpose of agitating the fluid in the fluid storage tank 14. The use of a bypass return pipe 24 in this manner is generally known in the art. The bypass return pipe or fluid inlet pipe 24, which includes a valve 27, is connected to the agitator 10 in the fluid storage tank 14.

Figure 1:
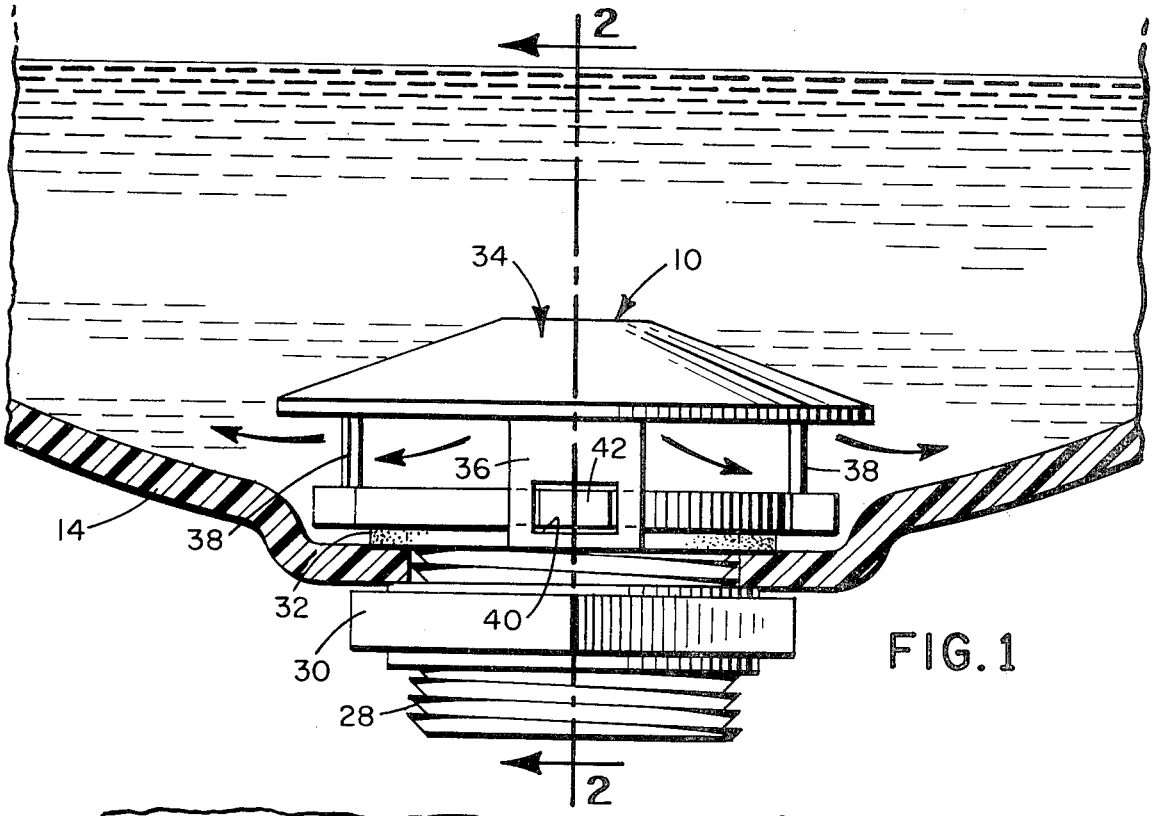
FIG. 1 is a side view of an agitator according to the present invention which is mounted on a fluid storage tank.

As illustrated in FIGS. 1 and 2, the agitator 10 is mounted on one of the walls of the fluid storage tank 14 by a tank fitting 28 and nut 30. A gasket 32 is also provided for sealing the inside wall of the fluid storage tank 14. The tank fitting 28 includes a threaded opening for engaging the bypass return pipe 24. Although as shown in FIG. 2 the agitator 10 is mounted on one of the walls of the fluid storage tank 14, it should be appreciated that the bypass return pipe 24 may be extended into the fluid in the fluid storage tank 14 in which event the agitator 10 would be fastened on the protruding end of the bypass return pipe 24 rather than mounted on the wall of the fluid storage tank 14. As is apparent from the discussion below, the agitator 10 performs less efficiently when connected in this alternative manner than when mounted on the wall of the fluid storage tank 14. In addition, although the agitator 10 is shown in FIGS. 1 and 2 in a vertical position on the bottom wall of the fluid storage tank 14, it should be appreciated that the agitator 10 may be mounted in other positions although it generally performs most efficiently when mounted as shown.

Figure 3:
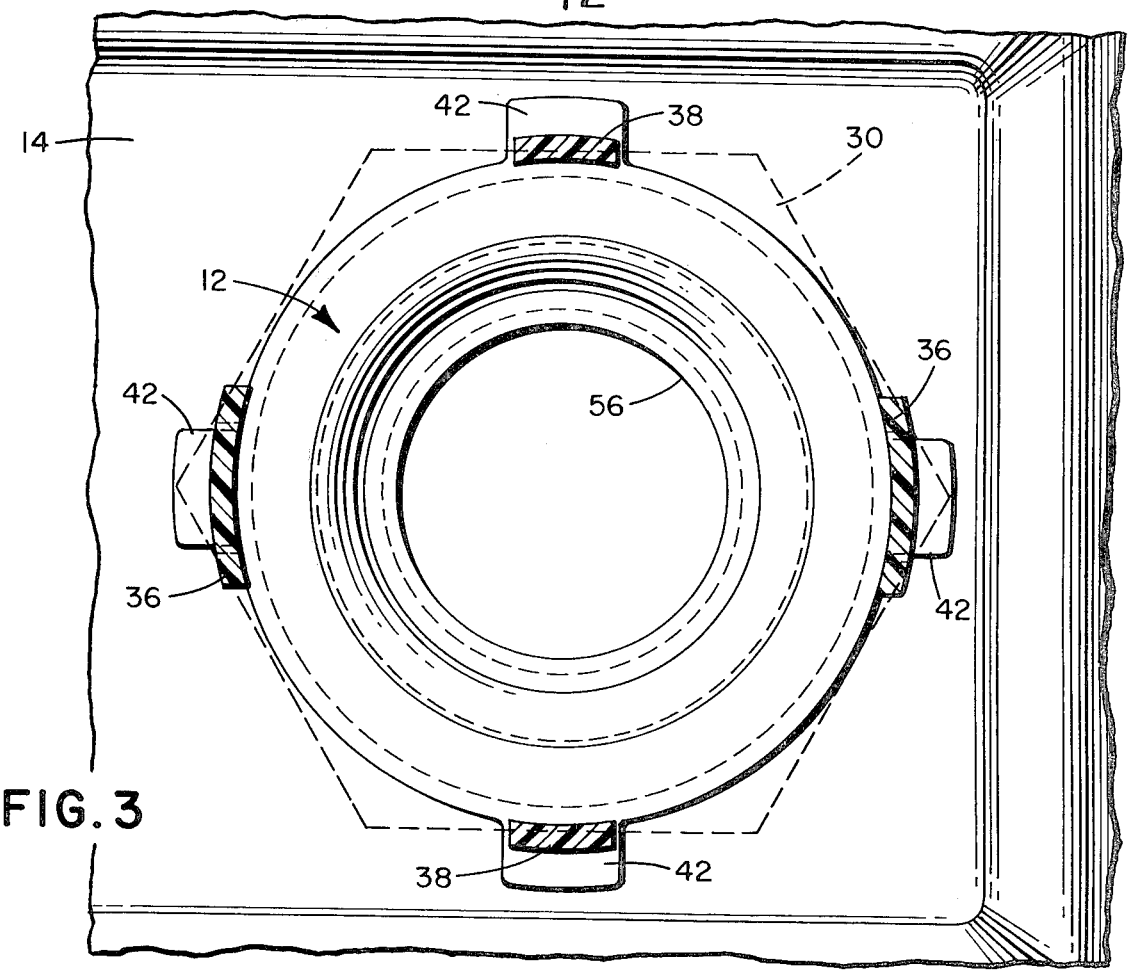
FIG. 3 shows a cross sectional view of the anti-vortex device taken along lines 3—3 of FIG. 2.

The agitator 10 includes a conical cap 34 which is mounted on the tank fitting 28 by a plurality of support bars 36 and 38. Although FIG. 3 shows a cross sectional view of the anti-vortex device 12, the conical cap 34 of the agitator 10 is coupled to the tank fitting 28 in the same manner. As shown in FIGS. 1–3, the support bars 36 include notches 40 for engaging tabs 42 on the tank fitting 28. On the other hand, the support bars 38 abutt another pair of tabs 42 on the tank fitting 28. Since the conical cap 34 may be formed of flexible plastic, the conical cap 34 may be removed from the tank fitting 28 by disconnecting the support bars 36 from the tabs 42 of the tank fitting 28.

The agitator 10 also includes an injector nozzle 44 which is mounted between the tank fitting 28 and the conical cap 34. The injector nozzle 44 directs the fluid from the bypass return pipe 24 to a location near the center or vortex of the conical cap 34. The concave surface of the conical cap 34 provides a focus for the fluid from the injector nozzle 44. Because of the shape of the conical cap 34, the fluid from the injector nozzle 44 is evenly distributed about the agitator 10 in the fluid storage tank 14. In the preferred embodiment, the agitator 10 is mounted on the bottom wall of the fluid storage tank 14 because solid particles which settle out of the fluid will be located on the bottom wall of the fluid storage tank 14. By providing a focus for the fluid in the bypass return pipe 24 and directing the fluid in a downward direction toward the bottom wall of the fluid storage tank 14, the conical cap 34 enables the agitator 10 to thorougly mix those particles which settle out of the fluid in the fluid storage tank 14. The conical cap 34 also naturally sheds sediment under the slightest movement of the fluid in the fluid storage tank 14 thereby preventing a loss of entrained material.

Figure 5:
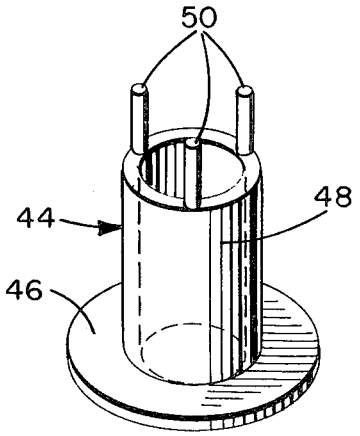
FIG. 5 is a perspective view of the injector nozzle of the agitator of FIGS. 1 and 2.

The injector nozzle 44 is illustrated in further detail in FIG. 5. The injector nozzle 44 includes an annular flange 46 which is supported by the tank fitting 28. An open cylinder 48 is attached to the flange 46 for directing the fluid in the bypass return pipe 24 toward the conical cap 34. A plurality of nozzle pins 50 extend between the cylinder 48 and the conical cap 34 for defining a fixed gap between the nozzle 44 and the conical cap 34. By defining the fixed gap, these spacer pins 50 determine the pressure drop across the nozzle 44 and the conical cap 34 which in turn controls the flow momentum in the fluid storage tank 14. For example, at high flow rates and/or high pressures, the fixed gap may be adjusted to allow the pressure drop across the bypass return pipe 24 to be insignificant compared to the pressure drop across the fixed gap. The fixed gap can be adjusted by shortening the spacer pins 50 and adding a spacer ring between the flange 46 of the nozzle 44 and the tank fitting 28 to compensate for the adjustment in the length of the spacer pins 50. Conversely, at low flow and/or low pressure the spacer pins 50 may be trimmed to increase the pressure drop across the fixed gap. As a result, the nozzle 44 of the present invention can be adjusted in size to ensure maximum momentum transfer across the fixed gap. Although the injector nozzle 44 need not be rigidly fastened to the tank fitting 28 or the conical cap 34 because of the use of spacer pins 50, it should be appreciated that the spacer pins 50 can be eliminated by rigidly fastening the injector nozzle 44 to the tank fitting 28 and varying the length of the nozzle cylinder 48 in order to achieve different fixed gaps.

Figure 4:
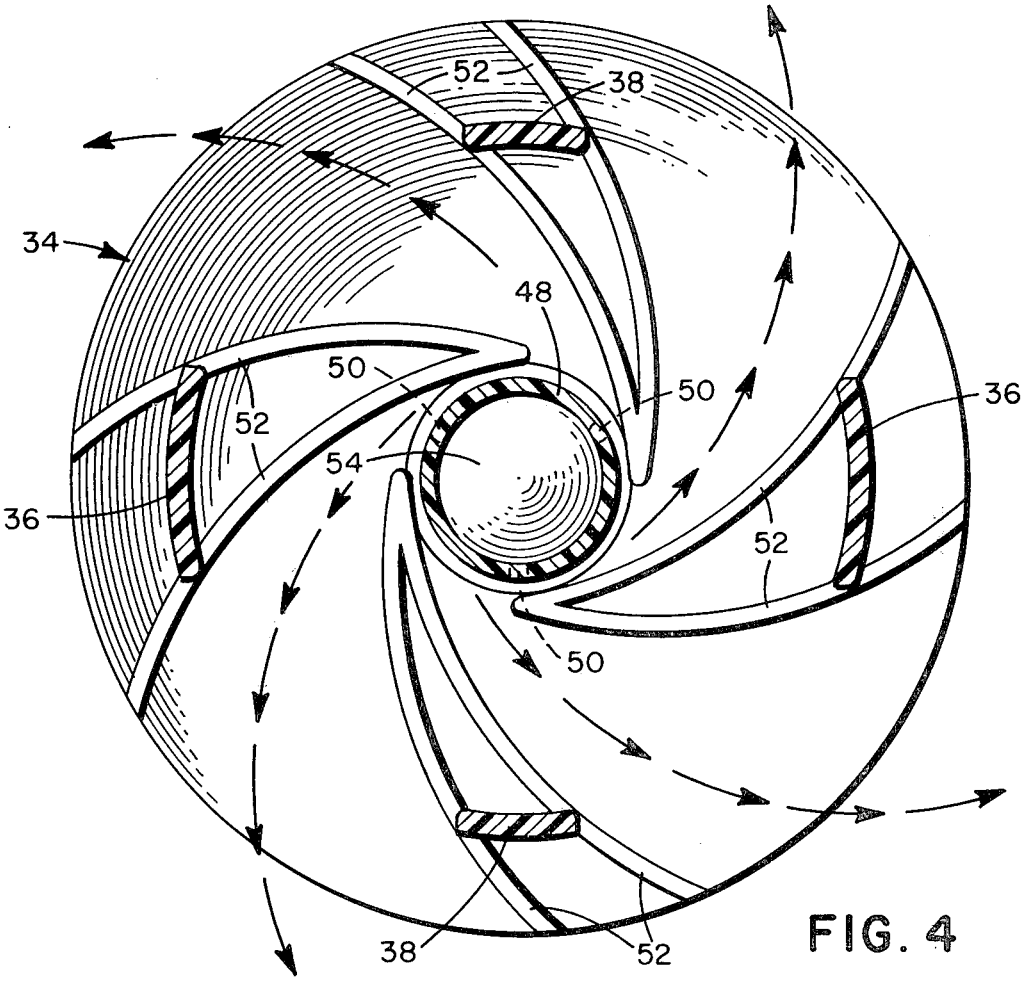
FIG. 4 shows a cross sectional view of the underside of the conical cap of the agitator taken along lines 4—4 of FIG. 2.

The concave side of the conical cap 34 is shown in further detail in FIG. 4. As shown therein, the conical cap includes a plurality of spiral ribs or fins 52. These spiral fins 52 extend from near the center to the rim of the conical cap 34. The purpose of these spiral fins 52 is to disperse the fluid from the bypass return pipe 24 in a spiral rotating fashion. The support bars 36 and 38 are enclosed by the spiral fins 52 so that they do not interfere with the flow of the fluid across the concave side of the conical cap 34. The spiral rotating motion of the fluid moving across the concave side of the cap 34 imparts a gentle rolling motion to the fluid in the fluid storage tank 14 which thoroughly mixes the fluid. Also, the conical cap 34 includes a deflecting cone 54 positioned at the center of the conical cap 34. The deflecting cone 54 deflects the fluid as it leaves the injector nozzle 44 to the concave surface of the conical cap 34. In this manner, the deflecting cone 54 ensures that the fluid is evenly distributed over the plurality of spiral fins 52 which in turn enhances the mixing of the fluid in the fluid storage tank 14.

The operation of the agitator 10 of the present invention is apparent from the above discussion. The agitator 10 transfers the momentum of the fluid in the bypass return pipe 24 and directs it in a proper manner to the fluid within the fluid storage tank 14 whereby thorough mixing of the fluid is accomplished. The fluid in the bypass return pipe 24 passes through an injector nozzle 44 in agitator 10 in an upward manner and then is diverted by a conical cap 34 which provides a focus for the bypass fluid. The conical cap thereby enhances the even distribution of the fluid across the spiral fins 52. By changing the direction of the momentum of the bypass fluid by 90 degrees and introducing a spiral or helical motion, the agitator 10 spins or rotates the bypass fluid. The momentum of the spinning bypass fluid is transferred to the fluid in the fluid storage tank 14 thereby giving a gentle rolling motion to the tank fluid. The maximum effectiveness of the agitator 10 occurs when it is positioned close to the bottom wall of the fluid storage tank 14 in order for the reflective flow from the conical cap 34 to cause the fluid momentum to be more efficiently used. The positioning of the agitator 10 on the bottom wall of the fluid storage tank 14 takes advantage of the fact that the solid particles generally settle on the bottom of the fluid storage tank 14 due to gravity. Thus, although the agitator 10 will work in any position on the fluid storage tank 14 and further will work on a protruding bypass return pipe 24, the maximum effectiveness of the agitator 10 occurs on the bottom wall of the fluid storage tank 14. Finally, since no air pressure or Venturi nozzle is used, air is not introduced into the fluid storage tank 14 which may result in foaming and cavitation of the pump 16. The agitator 10 of the present invention is a liquid-to-liquid device which transfers the momentum of the bypass fluid to the fluid in the fluid storage tank 14.

The anit-vortex device 12 is similar in construction to the agitator 10 except that the injector nozzle 44 of the agitator 10 has been removed. As shown in FIG. 2, the anti-vortex device 12 is mounted on the bottom wall of the fluid storage tank 14 by a tank fitting 56 which is similar in construction to tank fitting 28 of the agitator 10 except that the threaded opening of the tank fitting 56 is larger. The tank fitting 56 is mounted on the bottom wall of the fluid storage tank 14 by nut 30. A gasket 32 seals the inside wall of the fluid storage tank 14. An anti-vortex cap 58 is mounted on the tank fitting 56 by support bars 36 and 38 in the same manner as conical cap 34 is mounted to tank fitting 28 in agitator 10. Although the anti-vortex cap 58 is similar in construction to the conical cap 34 of the agitator 10 as shown in FIG. 2, this conical shape of the anti-vortex cap 58 has no major significance in the anti-vortex device 12. The primary reason for the similarity between these caps is for ease and simplicity of manufacturing. Likewise, the spiral fins 52 on the anti-vortex cap 58 do not perform any function. The only function of the conical shape of the anti-vortex cap 58 is to shed sediment which settles out of the fluid in the fluid storage tank 14. As in the case of the agitator 10, the anti-vortex cap 58 can be removed from the tank fitting 56 to facilitate the repair of the anti-vortex device 12 as well as to enable the user of either the agitator 10 or the anti-vortex device 12 to convert from one device to another by removing the injector nozzle 44.

The anti-vortex device 12 must be in a vertical position on the bottom wall of the fluid storage tank 14 in order to perform properly. The anti-vortex device 12 is connected to the fluid outlet pipe 18 which carries fluid from the fluid storage tank 14 to the pump 16. The purpose of the anti-vortex device 12 is to prevent the formation of a gyrating vortex in the fluid in the fluid storage tank 14. For example, without such a device, the low pressure at the suction side of the pump 16 would cause such a quantity of the fluid to move into the pump 16 as to cause a gyrating vortex or hollow core to be formed in the fluid at the inlet of the fluid outlet pipe 18. The formation of a gyrating vortex would allow air to enter the pump 16 which would cause the pump to lose prime and invariably cause a loss of pump efficiency.

On the other hand, the anti-vortex device 12 of the present invention forces any gyrating vortex in the fluid to make a substantially 90 degree turn in order to enter the inlet of the fluid outlet pipe 18. Since the vectorial momentum forces in the fluid will not permit the fluid to make a substantially 90 degree turn, any gyrating vortex becomes self-destructive. The operation of a gyroscope is somewhat analogous to the operation of the anti-vortex device 12. If one were to try to change the direction of a spinning gyroscope, the gyroscope would resist this change in direction due to the vectorial momentum forces stored in the spinning gyroscope. In the same manner, the vectorial momentum of the fluid will not be able to change direction as required by the positioning of the anti-vortex cap 58 over the opening in the tank fitting 56. As a result, in a very simple manner, the anti-vortex device 12 of the present invention improves the efficiency and life of the pump 16 by preventing the formation of a gyrating vortex.

Although illustrative embodiments of the present invention have been described in detail with reference to the accompanying drawings, it is to be understood that the invention is not limited to those precise embodiments and that various changes and modifications may be effected therein by one skilled in the art without departing from the scope or spirit of the invention. For example, it is to be understood that various changes and adjustments may be made in the size and positioning of the conical cap 34 of the agitator 10 and the anti-vortex cap 58 of the anti-vortex device 12. Variations may also be made in the gap between these caps 34 and 58 and their respective tank fittings 28 and 56. Also, variations may be made in the size and position of the injector nozzle 44 as well as the size of the openings in the tank fittings 28 and 56. It is further to be understood that the relative position of the agitator 10 with respect to the anti-vortex device 12 may be varied to improve the efficiency of the operation of the spraying apparatus of the present invention. These devices are shown immediately adjacent each other in FIG. 2 for purposes of illustration only.

I claims:

1. A spraying apparatus comprising:

a fluid storage tank;

pump means connected to said fluid storage tank by a fluid outlet pipe for pumping fluid from said fluid storage tank;

spray means connected to said pump by a spray pipe for spraying fluid pumped from said fluid storage tank;

a bypass return pipe connected between said spray pipe and said fluid storage tank for returning a portion of the fluid in said spray pipe to said fluid storage tank;

agitator means connected to said bypass return pipe in said fluid storage tank for mixing the fluid in said fluid storage tank by transferring the momentum of the fluid in said bypass return pipe to the fluid in said fluid storage tank, said agitator means comprising agitator cap means overlaying the opening in said bypass return pipe at a fixed distance therefrom for directing the fluid discharged by said bypass return pipe into said fluid storage tank in a spiral rotating fashion, said agitator cap means being formed by a conical plate having its concave side positioned adjacent the opening in said bypass return pipe to provide a focus for the fluid discharged thereby, said conical plate having spiral shaped fins on its concave side for imparting a spiral rotating motion to the fluid discharged by said bypass return pipe, and nozzle means coupled to said bypass return pipe for defining a fixed gap between said conical plate and said nozzle means to control the flow momentum in said fluid storage tank; and anti-vortex means connected to said fluid outlet pipe and mounted on the bottom wall of said fluid storage tank for preventing the formation of a gyrating vortex as the fluid in said fluid storage tank discharges through said fluid outlet pipe to thereby prevent pump cavitation in said pump means, said anti-vortex means including mounting means mounted on the bottom wall of said fluid storage tank and fastened to said fluid outlet pipe and anti-vortex cap means overlaying the opening of said fluid outlet pipe at a fixed distance therefrom for forcing the fluid in said fluid storage tank to make a substantially 90 degree turn in order to enter said fluid outlet pipe.

2. Spraying apparatus according to claim 1 wherein said agitator means is mounted on one of the walls of said fluid storage tank.

3. Spraying apparatus according to claim 2 wherein said one wall is the bottom wall of said fluid storage tank and said agitator means is mounted in a vertical position.

4. Spraying apparatus according to claim 1 wherein said bypass return pipe protrudes into said fluid storage tank and said agitator means is mounted on the protruding end of said bypass return pipe.

5. Spraying apparatus according to claim 1 wherein the size of said nozzle means can be varied to change the pressure drop across said nozzle means and said conical plate to thereby control the fluid momentum in said fluid storage tank.

6. Spraying apparatus according to claim 1 wherein said anti-vortex cap means extends beyond the opening in said fluid outlet pipe.

7. Spraying apparatus according to claim 1 wherein said anti-vortex cap means is positioned slightly above the opening in said fluid outlet pipe.

8. In a fluid storage tank having a fluid inlet, an agitator associated with said fluid inlet for mixing the fluid in said fluid storage tank by transferring the momentum of the fluid passing through said fluid inlet to the fluid in said fluid storage tank, said agitator comprising:

cap means overlaying said fluid inlet at a fixed distance therefrom for directing the fluid discharged by said fluid inlet into said fluid storage tank in a spiral rotating fashion to thereby mix the fluid in said fluid storage tank by imparting a gentle rolling motion to the fluid, said cap means being formed by a conical plate having its concave side positioned adjacent said fluid inlet at a fixed distance therefrom to provide a focus for the fluid discharged by said fluid inlet, said conical plate including spiral shaped fins mounted on its concave side for imparting a spiral rotating motion to the fluid passing through said fluid inlet; and nozzle means coupled to said fluid inlet and extending substantially along the center line of said conical plate for defining a fixed gap between said conical plate and said nozzle means to control the flow momentum in said fluid storage tank.

9. A fluid storage tank according to claim 8 wherein said nozzle means defines a fixed gap smaller than the height of said spiral shaped fins near the center of said conical plate.

10. A fluid storage tank according to claim 8 wherein said nozzle means extends between said fluid inlet and the concave side of said conical plate, said nozzle means including a plurality of pins coupled to said conical plate for defining the fixed gap between said conical plate and said nozzle means.

11. A fluid storage tank according to claim 10 wherein the length of said pins can be adjusted to vary the pressure drop across the fixed gap to thereby control the fluid momentum in said fluid storage tank.

12. A fluid storage tank according to claim 8 wherein said agitator is mounted on one of the walls of said fluid storage tank.

13. A fluid storage tank according to claim 12 wherein said agitator is mounted in a vertical position on the bottom wall of said fluid storage tank.

14. A fluid storage tank according to claim 8 wherein said agitator is mounted on the end of a fluid inlet pipe which protrudes into said fluid storage tank.

15. In a fluid storage tank having a fluid outlet on the bottom wall of said fluid storage tank, an anti-vortex device associated with said fluid outlet on said bottom wall to prevent the formation of a gyrating vortex as the fluid in said fluid storage tank passes through said fluid outlet, said anti-vortex device comprising:

mounting means associated with said fluid outlet and mounted on the bottom wall of said fluid storage tank;

cap means overlaying said fluid outlet at a fixed distance therefrom for preventing the formation of a gyrating vortex as the fluid passes through said fluid outlet by forcing the fluid in said fluid storage tank to make a substantially 90 degree turn in order to enter said fluid outlet, wherein said cap means includes support bars and said mounting means has a number of tabs corresponding to the number of said support bars on said cap means for attaching said support bars to said tabs, several of said support bars having notches for coupling said support bars to corresponding ones of said tabs, said cap means being removably mounted on said mounting means.

16. A fluid storage tank according to claim 15 wherein said cap means extends beyond the edges of said fluid outlet.

17. A fluid storage tank according to claim 16 wherein said cap means is formed by a conical plate which naturally sheds sediment under the slightest movement of the fluid in said fluid storage tank.

18. A fluid storage tank according to claim 15 wherein said cap means is positioned slightly above said fluid outlet.

19. Spraying apparatus for spraying fluid stored in a fluid storage tank comprising:

one or more spray heads;

pump means connected between said fluid storage tank and said spray heads for pumping fluid from said fluid storage tank to said spray heads, said pump means being connected to the bottom wall of said fluid storage tank by a fluid outlet pipe; and anti-vortex means mounted on the bottom wall of said fluid storage tank in a vertical position and connected to said fluid outlet pipe, said anti-vortex means including cap means overlaying the opening in said fluid outlet pipe at a fixed distance therefrom for preventing the formation of a gyrating vortex as the fluid in said fluid storage tank discharges through said fluid outlet pipe by forcing the fluid in said fluid storage tank to make a substantially 90 degree turn in order to enter said fluid outlet pipe to thereby prevent pump cavitation in said pump means, said anti-vortex means further including tank fitting means fastened to said fluid outlet pipe and mounted on said bottom wall of said fluid storage tank, said tank fitting means having a number of tabs, said cap means including a number of support bars corresponding to the number of said tabs for mounting said cap means on said tank fitting means, several of said support bars having notches for coupling said support bars to corresponding ones of said tabs.

20. Spraying apparatus according to claim 19 wherein said cap means extends beyond the opening in said fluid outlet pipe.

21. Spraying apparatus according to claim 19 wherein said cap means is positioned slightly above the opening in said fluid outlet pipe.

22. In spraying apparatus for spraying a fluid stored in a fluid storage tank, said spraying apparatus including one or more spray heads, a pump connected to said fluid storage tank by a fluid outlet pipe for pumping fluid through a spray pipe to said spray heads and a bypass return pipe connected between said spray pipe and said fluid storage tank to supply a portion of the fluid in said spray pipe to said fluid storage tank, a tank fitting for use as either an agitator when mounted on said bypass return pipe in said fluid storage tank or an anti-vortex device when mounted on said fluid outlet pipe in said fluid storage tank, said tank fitting comprising:

mounting means for fastening said tank fitting to either said bypass return pipe or said fluid outlet pipe, said mounting means including a plurality of support tabs;

cap means overlaying the opening in either said bypass return pipe or said fluid outlet pipe at a fixed distance therefrom, said cap means being removably mounted on said mounting means by a plurality of support bars associated with corresponding ones of said plurality of support tabs on said mounting means; and nozzle means coupled between said mounting means and said cap means for defining a fixed gap between said cap means and said nozzle means to control the fluid momentum in said fluid storage tank when said tank fitting is connected to said bypass return pipe as an agitator, said nozzle means being removable from said tank fitting to convert said tank fitting from an agitator to an anti-vortex device when said tank fitting is mounted on said fluid outlet pipe.

23. Spraying apparatus according to claim 22 wherein said cap means is formed by a conical plate having its concave side positioned adjacent the opening in either said bypass return pipe when said tank fitting is used as an agitator or said fluid outlet pipe when said tank fitting is used as an anti-vortex device, said conical plate including spiral shaped fins mounted on the concave side of said conical plate for imparting a spiral rotating motion to the fluid discharged by said bypass return pipe when said tank fitting is used as an agitator.

24. In a fluid storage tank having a fluid inlet, an agitator associated with said fluid inlet for mixing the fluid in said fluid storage tank by transferring the momentum of the fluid passing through said fluid inlet to the fluid in said fluid storage tank, said agitator comprising:

cap means overlaying said fluid inlet at a fixed distance therefrom for directing the fluid discharged by said fluid inlet into said fluid storage tank in a spiral rotating fashion to thereby mix the fluid in said fluid storage tank by imparting a gentle rolling motion to the fluid, said cap means being formed by a conical plate having its concave side positioned adjacent said fluid inlet at a fixed distance therefrom to provide a focus for the fluid discharged by said fluid inlet, said conical plate including spiral shaped fins mounted on its concave side for imparting a spiral rotating motion to the fluid passing through said fluid inlet; and nozzle means coupled to said fluid inlet and extending substantially along the center line of said conical plate for defining a fixed gap between said conical plate and said nozzle means to control the flow momentum in said fluid storage tank, wherein said agitator is mounted on one of the walls of said fluid storage tank, said agitator further comprising tank fitting means associated with said fluid inlet for attaching said agitator to said one wall of said fluid storage tank, said nozzle means being freely supported between said tank fitting means and said conical plate, said conical plate including a plurality of support bars and said tank fitting means including a corresponding plurality of tabs for attaching said support bars to said tank fitting means.

25. A fluid storage tank according to claim 24 wherein said agititor is formed of plastic and a number of said support bars have notches for coupling said support bars to corresponding ones of said tabs, said conical plate and said nozzle means being removably mounted on said tank fitting means to facilitate repair of said agitator.

* * * * *